US006515643B1

(12) United States Patent
Kamiko et al.

(10) Patent No.: US 6,515,643 B1
(45) Date of Patent: Feb. 4, 2003

(54) IMAGE DISPLAY APPARATUS SUITED TO VIEWFINDER

(75) Inventors: Mitsuo Kamiko, Miyagi-ken (JP); Tomoyasu Katsuyama, Kanagawa-ken (JP); Yoshihiro Date, Kanagawa-ken (JP); Naoki Hagiwara, Kanagawa-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/448,544

(22) Filed: Nov. 23, 1999

(30) Foreign Application Priority Data

Dec. 1, 1998 (JP) ..... 10-342161

(51) Int. Cl.[7] ..... G09G 3/36

(52) U.S. Cl. ..... 345/87; 345/100; 345/103; 345/102; 348/171; 348/333; 348/341; 396/232

(58) Field of Search ..... 345/87, 55, 103, 345/100, 38, 102; 348/171, 333, 341; 396/232, 296

(56) References Cited

U.S. PATENT DOCUMENTS

| | | | | |
|---|---|---|---|---|
| 5,248,963 A | | 9/1993 | Yasui et al. | 345/98 |
| 5,600,344 A | * | 2/1997 | Sono et al. | 345/87 |
| 5,699,115 A | * | 12/1997 | Hiraki et al. | 348/333.13 |
| 5,841,431 A | * | 11/1998 | Simmers | 345/103 |
| 5,850,205 A | * | 12/1998 | Blouin | 345/102 |
| 6,124,853 A | * | 9/2000 | Palalau et al. | 345/100 |
| 6,219,022 B1 | * | 4/2001 | Yamazaki et al. | 345/103 |
| 6,246,399 B1 | * | 6/2001 | Yamane et al. | 345/103 |
| 6,262,704 B1 | * | 7/2001 | Kurumisawa et al. | 345/100 |

FOREIGN PATENT DOCUMENTS

| | | |
|---|---|---|
| JP | 02244880 A | 9/1990 |
| JP | 04334276 A | 11/1992 |
| JP | 05284391 A | 10/1993 |
| JP | 08111795 A | 4/1996 |
| JP | 08191408 A | 7/1996 |

* cited by examiner

*Primary Examiner*—Bipin Shalwala
*Assistant Examiner*—Jimmy H. Nguyen
(74) *Attorney, Agent, or Firm*—Brinks Hofer Gilson & Lione

(57) ABSTRACT

An image display apparatus has a main display area in which a plurality of pixels are arranged horizontally and vertically in an array condition, and at least one sub display area in which a plurality of pixels are arranged horizontally and vertically in an array condition, provided separately from and outside the main display area. In the image display apparatus, two types of lines are arranged in a matrix manner horizontally and vertically against the main display area and the sub display area to drive the plurality of pixels, and driving units for applying driving signals to the lines arranged in the matrix manner are also provided.

7 Claims, 7 Drawing Sheets

IMAGE DISPLAY APPARATUS SUITED TO VIEWFINDER

BACKGROUND OF THE INVENTION

1. Field of the Invention

The present invention relates to image display apparatuses suited to a viewfinder which is connected to a TV camera and used for focusing and other purposes.

2. Description of the Related Art

A camera operator uses the viewfinder of a TV camera in a studio of a broadcasting station for focusing and checking a composition. At a side of the viewfinder of the TV camera, a lamp called a tally lamp is provided.

This tally lamp indicates which TV camera is being used in broadcasting when a TV screen is formed by switching the images sent from a plurality of TV cameras. In general, two tally lamps are provided for a TV camera, one for the cast at a position where the cast can easily see it from the front side of the TV camera, such as the top of the center of the TV camera, and the other for the camera operator at a position where the camera operator can easily see, such as the side of the viewfinder.

Therefore, a camera operator can understand from the on state of the tally lamp of the TV camera the operator manipulates whether the TV camera is being selected as the camera sending the image used for the actual TV screen even while a plurality of TV cameras take images of the cast.

In a TV camera used in a broadcasting station, generally, a viewfinder is formed of a cathode-ray tube (CRT); and a tally lamp is formed of a high-luminance light-emitting diode (LED) and mounted on an image frame provided outside the screen of the viewfinder, separately from the screen.

Since it is strongly demanded in recent years that TV cameras used in a broadcasting station be made compact and lightweight, viewfinders have been formed of liquid-crystal apparatuses to make the viewfinders more compact and thinner. Even when the viewfinders are made more compact and thinner with the use of liquid-crystal apparatuses, however, since the LEDs used for tally lamps are about 6 mm thick, the viewfinders become thick by the thickness of the tally lamps, which prevents the viewfinders from being thinner and more compact.

Red and green tally lamps are usually used for this purpose, and different colors indicate different meanings. If the colors of tally lamps need to be changed due to the demand of the user to a color other than red and green, since the colors of LEDs are limited, tally lamps having various colors cannot be prepared. In addition, tally lamps formed of LEDs just indicate the on and off states of red or green lamps, and cannot indicate character information.

Depending on the surrounding environment of a place where these tally lamps are used, it may be difficult to identify the on states of the lamps, or conversely, the lamps may become obstacles due to their high luminance. Therefore, it is necessary to make the luminance variable according to the surrounding environment of use, but to increase the luminance of the tally lamps formed of LEDs, the voltage applied thereto needs to be increased, which increases power consumption.

SUMMARY OF THE INVENTION

The present invention has been made in consideration of the above conditions. Accordingly, an object of the present invention is to provide an image display apparatus which provides a sub display area that can serve as a tally lamp to eliminate a tally lamp formed of a LED, which has been conventionally required; which allows a viewfinder provided with the function of a tally lamp to be made thinner; and which also allows power consumption to be reduced. Another object of the present invention is to provide an image display apparatus which allows a sub display area to display character information and image information.

One of the foregoing objects is achieved according to the present invention through the provision of an image display apparatus including a main display area having a plurality of pixels arranged horizontally and vertically in an array condition; at least one sub display area disposed separately from the main display area and having a plurality of pixels arranged horizontally and vertically in an array condition; a plurality of lines arranged horizontally and vertically in a matrix manner against the main display area and the sub display area for driving the plurality of pixels; and driving means for applying a driving signal to the plurality of lines disposed in the matrix manner.

Since the driving means can send a signal other than an image signal to be displayed on the main display area to the at least one sub display area formed outside the main display area, information substituting for the display of a tally lamp can be indicated on the sub display area. Unlike a case in which an LED lamp is separately provided, since the sub display area is formed outside the main display area on the same plane as the main display area, the image display apparatus does not need to be thick. Therefore, even when the sub display area is provided, the image display apparatus does not become thicker than required.

In addition, when the transmittance of the liquid crystal in the sub display area is made variable separately from the main display area, with the use of a dimmer control signal, the luminance of the sub display area can be adjusted to a level suited to the surrounding environment of use without increasing power consumption.

In the present invention, pixels disposed at the outer periphery of the main display area may be used for displaying an image frame.

When the pixels used for displaying the image frame are driven separately from those used for displaying an image, the boundary between the main display area and the sub display area can be easily understood by the user as the image frame, and the distinction between the sub display area and the main display area can be easily made.

When the main display area and the sub display are made in a liquid-crystal display apparatus, an image display apparatus that provides the thinness and compactness which the liquid-crystal display apparatus inherently possesses and that allows the sub display area to function as a tally lamp is provided. Further, when the sub display area is driven through the lines therefor, character information and image information can be displayed on the sub display area. Therefore, in addition to the single-color turning-on display function which the conventional tally lamp fulfills, a desired indicator, character information, or image information can be displayed as information separated from that shown on the main display area. When the liquid-crystal display apparatus drives pixels by the use of thin-film transistors, the sub display area provides quick response.

Furthermore, in the present invention, luminance-signal control means for controlling the luminance of the sub display area may be provided for the image display apparatus.

In the present invention, the main display area and the sub display area may be formed of an active-matrix liquid-crystal display panel.

In the present invention, the main display area and the sub display area may be formed of a passive-matrix liquid-crystal display panel.

DESCRIPTION OF THE PREFERRED EMBODIMENTS

Embodiments of the present invention will be described below in detail. The present invention is not limited to those embodiments.

Figure 1:
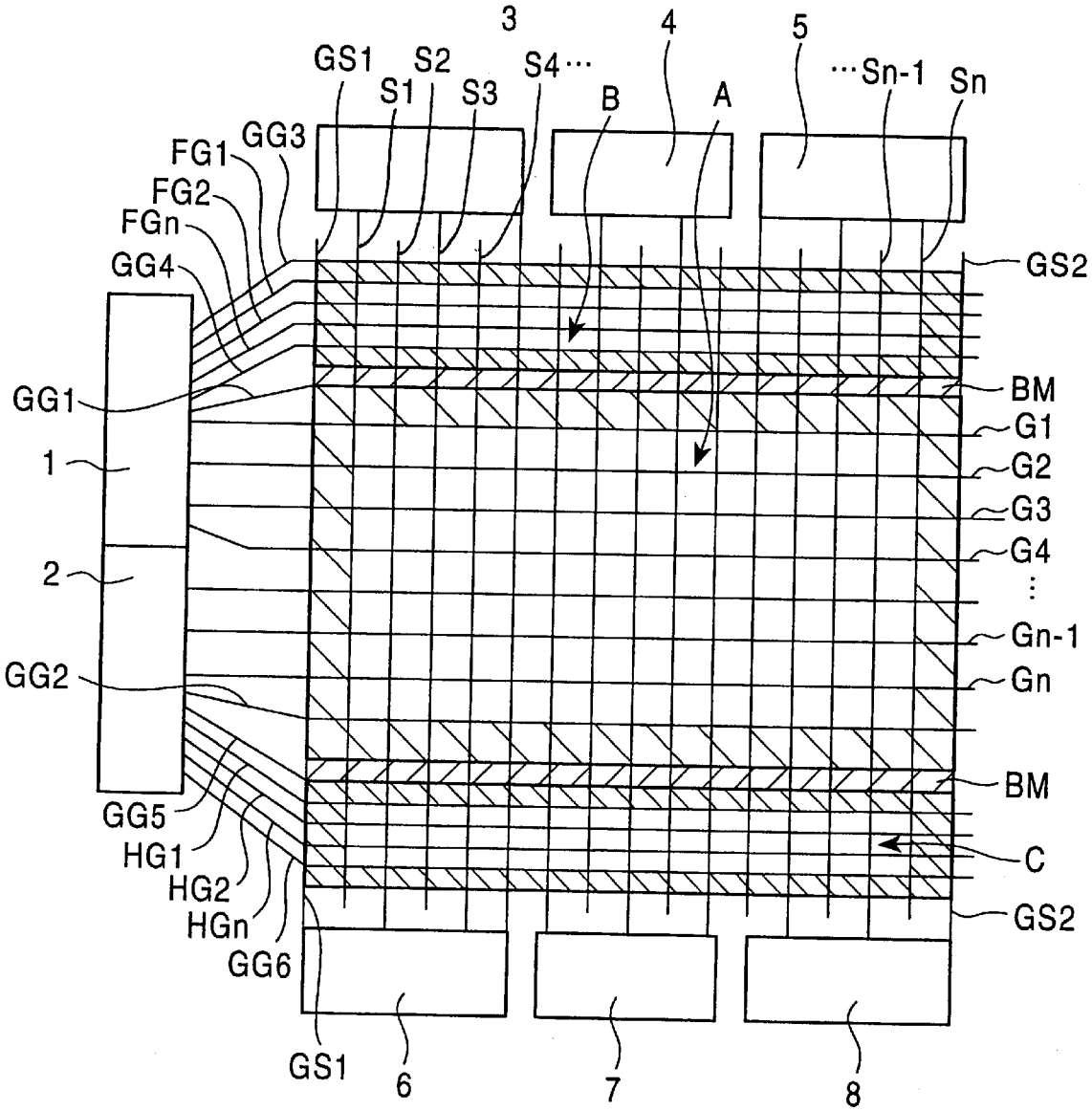
FIG. 1 is an outlined circuit diagram of a liquid-crystal display apparatus according to a first embodiment of the present invention.
Figure 2:
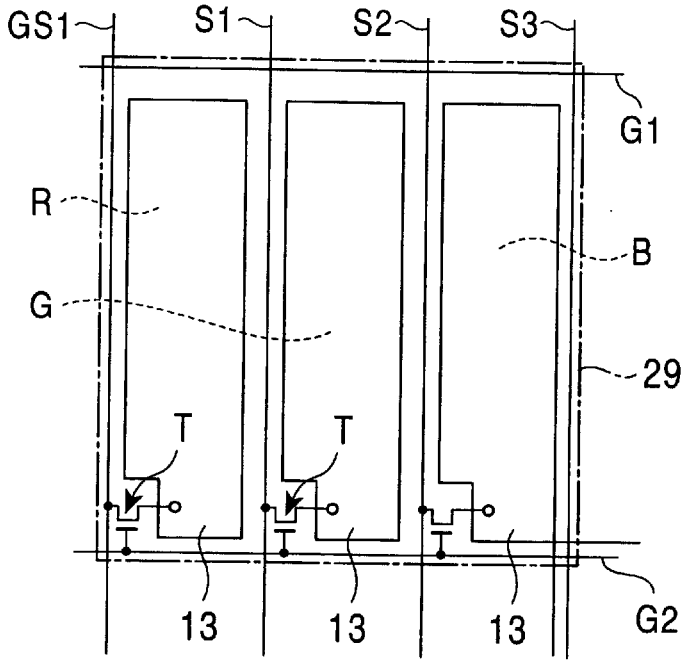
FIG. 2 is a partially enlarged view of a circuit shown in FIG. 1.
Figure 3:
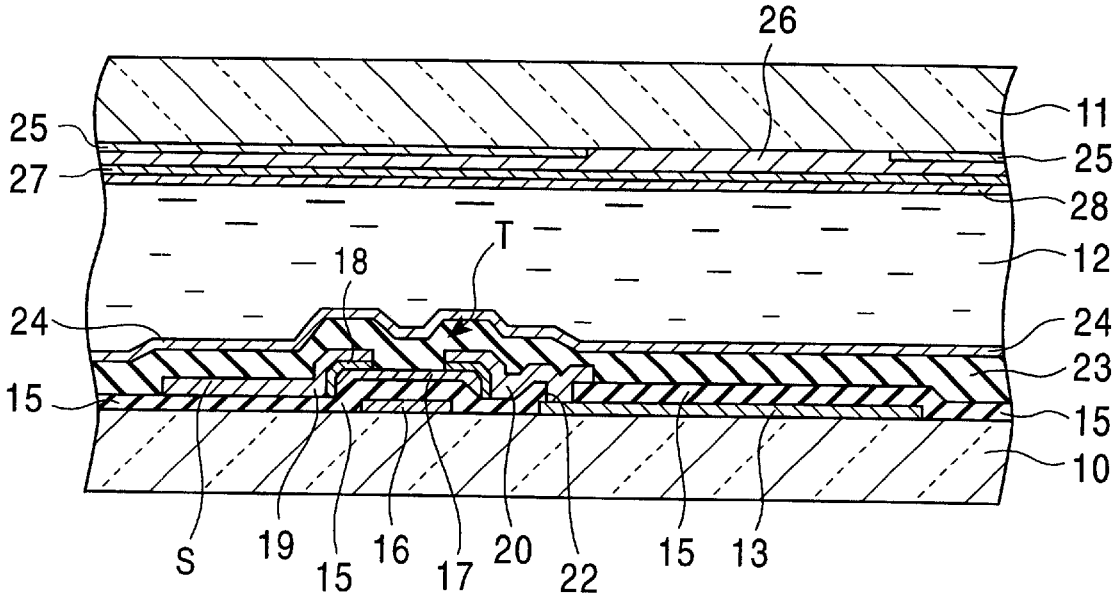
FIG. 3 is a cross-sectional view of a circuit shown in FIG. 1, formed on an actual liquid-crystal substrate.

FIG. 1 to FIG. 3 show an outlined circuit structure of an active-matrix liquid-crystal display apparatus according to a first embodiment of the present invention.

In the structure shown in FIG. 1 and FIG. 2, a number of gate lines G1, G2, G3, G4, . . . , and Gn and a number of source lines S1, S2, S3, . . . , and Sn are disposed in a matrix manner, and an area enclosed by the gate lines G1, G2, G3, G4, . . . , and Gn and the source lines Sl, S2, S3, and Sn serve as a main display area A. The gate lines G1, G2, . . . , and Gn are connected to either of gate drivers (gate-line driving means) 1 and 2, and the source lines S1, S2, . . . , and Sn are connected to one of source drivers (source-line driving means) 3, 4, 5, 6, 7, and 8. The circuit shown in FIG. 1 and FIG. 2 is a simplified circuit formed on one transparent substrate, in the structure of the liquid-crystal display apparatus in which liquid crystal is sealed between transparent substrates, which will be described later by referring to FIG. 3.

In FIG. 1, for simplicity, the number of the gate lines G1, G2, . . . , and Gn and that of the source lines S1, S2, and Sn are small, but they are actually set to appropriate numbers according to the resolution of a TV image to be displayed on the main display area A. For example, 540 gate lines and 2880 (960 multiplied by three for three primary colors for color display) source lines are provided for the main display area A of the present embodiment according to the resolution of a usual TV image.

The number of the gate drivers and that of the source drivers, connected to the above lines, are also set to appropriate numbers according to the resolution of a TV image to be displayed on the main display area A. More specifically, since a currently main gate driver can connect to about 190 gate lines, the required number of gate drivers for the used gate lines are provided, for example, three gate drivers (for simplicity, only two gate drivers are shown in FIG. 1) are provided when 540 gate lines are used.

Since a currently main source driver can connect to about 310 source lines, the required number of source drivers for the used source lines are provided, for example, 10 source drivers for the three primary colors (for simplicity, only six source drivers are shown in FIG. 1) are provided when 960 sourse lines are used.

In the present embodiment, among the gate lines G1, G2, . . . , and Gn shown in FIG. 1, half of them having smaller suffix numbers are connected to a gate driver (driving means) 1 disposed at the upper left side of the main display area A, and the remaining gate lines are connected to a gate driver (driving means) 2 disposed adjacently to the gate driver 1. All the gate lines G1, G2, . . . , and Gn can be driven.

At the upper side of the main display area A shown in FIG. 1, source drivers (driving means) 3, 4, and 5 are disposed from the left apart from the main display area A, and at the lower side of the main display area A, source drivers (driving means) 6, 7, and 8 are disposed from the left apart from the main display area A. Among the source lines S1, S2, S3, . . . , and Sn, odd-numbered source lines are connected to source drivers disposed at positions where the source lines are extended in the upper side of the main display area A, and even-numbered source lines are connected to source drivers disposed at positions where the source lines are extended in the lower side of the main display area A.

Therefore, for example, in FIG. 1, since the odd-numbered source lines S1, S3, S5, . . . are connected to the source drivers 3, 4, and 5 disposed at the upper side of the main display area A and the even-numbered source lines S2, S4, S6, . . . are connected to the source drivers 6, 7, and 8 disposed at the lower side of the main display area A, the source lines are alternately connected to the upper and lower source drivers.

Between the main display area A and the source drivers 3, 4, and 5 disposed thereabove, a first sub display area B having the same width as the main display area A and a smaller height than the main display area A is disposed separately from the main display area A. Between the main display area A and the source drivers 6, 7, and 8 disposed therebelow, a second sub display area C having the same width and the same height as the sub display area B is disposed separately from the main display area A.

In the first sub display area B, located between the main display area A and the source drivers 3, 4, and 5, a plurality of sub gate lines FG1, FG2, . . . , and FGn (for simplicity, only three of them, FG1, FG2, and FGn, are shown in FIG. 1) connected to the gate driver 1 and a plurality of sub source lines which are parts of the source lines S1, S2, . . . , and Sn, extending from the main display area A to the source drivers 3, 4, and 5, are arranged.

In the second sub display area C, located between the main display area A and the source drivers 6, 7, and 8, a plurality of sub gate lines HG1, HG2, . . . , and HGn (for simplicity, only three of them, HG1, HG2, and HGn, are shown in FIG. 1) connected to the gate driver 2 and a plurality of sub source lines which are parts of the source lines S1, S2, . . . , and Sn, extending from the main display area A to the source drivers 6, 7, and 8, are arranged.

A gate line GG1 for an image frame is formed above the first gate line G1 shown in FIG. 1, and a gate line GG2 for the image frame is formed below the n-th gate line Gn. With these gate lines GG1 and GG2 for the image frame, the upper end and the lower end of the main display area A are determined. A gate line GG3 for the image frame of the first sub display area B is formed above the first sub gate line FG1 for the first sub display area B, and a gate line GG4 for the image frame of the first sub display area B is formed below the last sub gate line FGn for the first sub display area B. With these gate lines GG3 and GG4 for the image frame, the upper end and the lower end of the first sub display area B are determined in FIG. 1. A gate line GG5 for the image frame of the second sub display area C is formed above the first sub gate line HG1 for the second sub display area C, and a gate line GG6 for the image frame of the second sub display area C is formed below the last sub gate line HGn for the second sub display area C. With these gate lines GG5 and GG6 for the image frame, the upper end and the lower end of the second sub display area C are determined in FIG. 1.

At the left side of the first source line Si shown in FIG. 1, a source line GS1 for the image frames connected to the source driver 6 is disposed and passes through the left ends of the second sub display area C, the main display area A, and the first sub display area B. At the right side of the n-th source line Sn, a source line GS2 for the image frames connected to the source driver 8 is disposed and passes through the right ends of the second sub display area C, the main display area A, and the first sub display area B. With these source lines GS1 and GS2 for the image frames, the right and left ends of the first sub display area B, the right and left ends of the main display area A, and the right and left ends of the second sub display area C are determined.

In addition, at the boundary between the main display area A and the sub display area B and at the boundary between the main display area A and the sub display area C, black matrixes BM are formed to partition each area.

FIG. 2 is a partially enlarged view of a circuit shown in FIG. 1. FIG. 3 shows a typical example structure of the liquid-crystal display apparatus of the present embodiment, in which the circuit shown in FIG. 1 is actually formed on a transparent substrate.

In the liquid-crystal display apparatus of the present embodiment, liquid crystal 12 is sealed between a pair of transparent substrates 10 and 11 disposed oppositely in the vertical direction as shown in FIG. 3. On the transparent substrate 10, the source lines and the gate lines are disposed in a matrix manner when viewed from the top, specifically, they are actually intersected three-dimensionally while they are insulated from each other; pixel electrodes 13 are formed between the source lines and the gate lines; and a thin-film transistor T is formed at one end of each pixel electrode 13.

More specifically, a number of pixel electrodes 13 are formed separately from each other at an equal interval on the substrate 10 while they are arranged horizontally and vertically in an array condition. The gate lines are disposed horizontally between the pixel electrodes 13 on the substrate 10, and an insulating film 15 is provided as shown in FIG. 3 to cover these elements. A gate electrode 16 is formed at the one end of each pixel electrode 13 by extending a part of a gate line G. and a thin transistor T formed of a semiconductor active film 17, ohmic contact films 18 disposed at both ends thereof, a source electrode 19, and a drain electrode 20 is formed on the insulating film 15 above the gate electrode 16. The source lines are formed such that they are intersected with the gate lines three dimensionally and are disposed in a matrix manner when viewed from the top, on the insulating film 15. The drain electrode 20 is connected to the pixel electrode 13 through a contact hole 22 formed in the insulating film 15. An insulating film 23 is formed to cover the above elements, and an alignment layer 24 is further formed on the insulating film 23.

At the lower side of the substrate 11, black masks 25, a color filter 26, a common electrode film 27, and an alignment film 28 are laminated. The substrate 10 and the substrate 11 are integrated such that the color filter 26 faces the pixel electrodes 13, to form the liquid-crystal display apparatus.

In the color filter 26, red (R), green (G), and blue (B) portions are sequentially arranged against pixel electrodes 13 as shown in FIG. 2. A region corresponding to three pixel electrodes 13 forms one pixel 29 to allow color display.

The liquid-crystal display apparatus is configured as described above in the present embodiment. The shapes and arrangement relationships of the pixel electrodes 13, the gate electrodes 16, the semiconductor active film 17, the drain electrodes 19, and the source electrodes 20 and the arrangement of the color filter 26 can be of various types and may be modified. Any structure can be used if a liquid-crystal display apparatus having thin-film transistors as switching elements allows display while its gate lines and source lines are arranged as shown in FIG. 1.

In FIG. 1, the black matrix BM formed at the boundary between the main display area A and the first sub display area B separates the main display area A and the sub display area B, and the black matrix BM formed at the boundary between the main display area A and the second sub display area C separates the main display area A and the sub display area C. A part of the black masks 25 provided at the lower side of the substrate 11 in the structure shown in FIG. 3 may be extended and used as these black matrixes BM.

When a black mask is formed inside the substrate 10 at the upper side of the substrate 10, it may be extended and used. The black matrixes BM need to be formed at the positions of the substrate 10 or 11 corresponding to the boundaries between the display areas A and B and between the display areas A and C in order to visually separate the display areas clearly.

The relationship between the practical numbers of the gate lines and the source lines and the numbers of lines connected to the gate drivers and the source drivers in the sub display areas B and C in the liquid-crystal display apparatus shown in FIG. 1 will be described next.

Currently, a general-purpose gate driver has 192 connection lines and a general-purpose source driver has 309 connection lines. To display a TV image on the main display area successfully in the structure shown in FIG. 1, as described above, 540 gate lines and 2880 (960 multiplied by 3) source lines are required in the main display area A. In addition, since two additional gate lines are required for the image frame of the main display area A at the upper and lower portions, a total of 542 gate lines are necessary. When three of the above gate drivers are used, since 576 (192 multiplied by 3) gate lines can be connected, 34 (576−542) gate lines are unused to allow about 10 gate lines for the first sub display area and about 10 gate lines for the second display area to be connected. When 10 gate lines are used in each of the sub display areas B and C, two lines are used for the image frame and eight lines are used for information display.

When 10 of the above source drivers are used, since 3090 (309 multiplied by 10) source lines can be connected and 2886 (962 multiplied by 3) source lines are required for the three primary colors, including two source lines for the right and left image frames for the main display area A and the sub display areas B and C, 204 (3090–2886) source lines are unused to sufficiently handle the case. Therefore, even if the sub display areas B and C are provided in the present embodiment, the numbers of general-purpose gate drivers and source drivers required in a conventional case do not need to be increased, and gate connection portions which are conventionally unused are used for display in the sub display areas.

In the image frame for the main display area A in the circuit shown in FIG. 1, the gate line GG1 for the image frame and the source lines GS1, S1, S2, . . . , Sn, and GS2 intersecting therewith are used for displaying the upper end of the image frame, and the gate line GG2 for the image frame and the source lines GS1, S1 S2, . . . , Sn, and GS2 intersecting therewith are used for displaying the lower end of the image frame. The gate lines GG1, G1, G2, . . . , Gn, and GG2 and the source line GS1 for the image frame are used for displaying the left end of the image frame for the main display area A, and the gate lines GG1, G1, G2, . . . , Gn, and GG2 and the source line GS2 for the image frame are used for displaying the right end of the image frame for the main display area A.

The image frame for the main display area A is shown in FIG. 1 as a hatched region to discriminate the image frame from the main display area A.

In the image frame for the sub display area B in the circuit shown in FIG. 1, the gate line GG3 for the image frame and the source lines GS1, S1, S2, . . . , Sn, and GS2 intersecting therewith are used for displaying the upper end of the image frame, and the gate line GG4 for the image frame and the source lines GS1, S1, S2, . . . , Sn, and GS2 intersecting therewith are used for displaying the lower end of the image frame. The gate lines GG3, FG1, FG2, . . . , FGn, and GG4 and the source line GS1 for the image frame are used for displaying the left end of the image frame for the sub display area B, and the gate lines GG3, FG1, FG2, . . . , FGn, and GG4 and the source line GS2 for the image frame are used for displaying the right end of the image frame for the sub display area B.

The image frame for the sub display area B is shown in FIG. 1 as a hatched region to discriminate the image frame from the sub display area B.

In the image frame for the sub display area C in the circuit shown in FIG. 1, the gate line GG5 for the image frame and the source lines GS1, S1, S2, . . . , Sn, and GS2 intersecting therewith are used for displaying the upper end of the image frame, and the gate line GG6 for the image frame and the source lines GS1, S1, S2, . . . , Sn, and GS2 intersecting therewith are used for displaying the lower end of the image frame. The gate lines GG5, HG1, HG2, . . . , HGn, and GG6 and the source line GS1 for the image frame are used for displaying the left end of the image frame for the sub display area C, and the gate lines GG5, HG1, HG2, . . . , HGn, and GG6 and the source line GS2 for the image frame are used for displaying the right end of the image frame for the sub display area C.

The image frame for the sub display area C is shown in FIG. 1 as a hatched region to discriminate the image frame from the sub display area C.

In the liquid-crystal display apparatus having the structure shown in FIG. 1 to FIG. 3, the gate lines G1, G2, . . . , and Gn and the source lines S1, S2, . . . , and Sn are driven to drive the pixel electrodes 13 in the main display area A, and thereby a usual TV image is displayed on the main display area A, as in a conventional liquid-crystal display apparatus.

When the gate lines and source lines disposed in the sub display areas B and C are used to drive the pixel electrodes 13 in the sub display areas B and C, desired information can be displayed on the sub display areas B and C.

In this case, when the sub display areas B and C are used as a substitute for a tally lamp, if liquid-crystal alignment control is performed by the use of the pixel electrodes 13 corresponding to red color filters so as to display a red sign, a red horizontal bar can be displayed at the sub display areas B and C, which are above and below the main display area A. This red bar serves as a tally lamp.

Since any color display can be used in the sub display areas B and C, a desired color indication is possible, in addition to red and green indications conventionally used by tally lamps. Therefore, the sub display areas B and C can be used for various color indications as well as for the function of a tally lamp. A user's favorite color can be selected. Furthermore, when a number of pixel electrodes 13 are appropriately driven in the sub display areas B and C, characters and images can be displayed in color, in addition to color indications.

Since gate lines and source lines are provided at the outer periphery of the main display area A for the image frame, the image frame can be indicated in color. The image frame of the main display area A can be displayed in a desired color. In the same way, since gate lines and source lines are provided at the outer peripheries of the sub display areas B and C for the image frames, the image frames can be indicated in color. The image frames of the sub display areas B and C can be displayed in a desired color.

In the liquid-crystal display apparatus of the present embodiment, an indication serving as a substitute for a tally lamp can be shown in the sub display areas B and C. Since the sub display areas B and C are integrated into the liquid-crystal display apparatus with a part of gate lines and source lines being used therefor and it is not necessary to separately provide an LED for the liquid-crystal display apparatus, the display apparatus is made thinner by the amount of the LED. Therefore, a more compact and thinner display apparatus having a tally-lamp display function and allowing a desired image to be displayed in color in the sub display areas B and C is provided.

Figure 4:
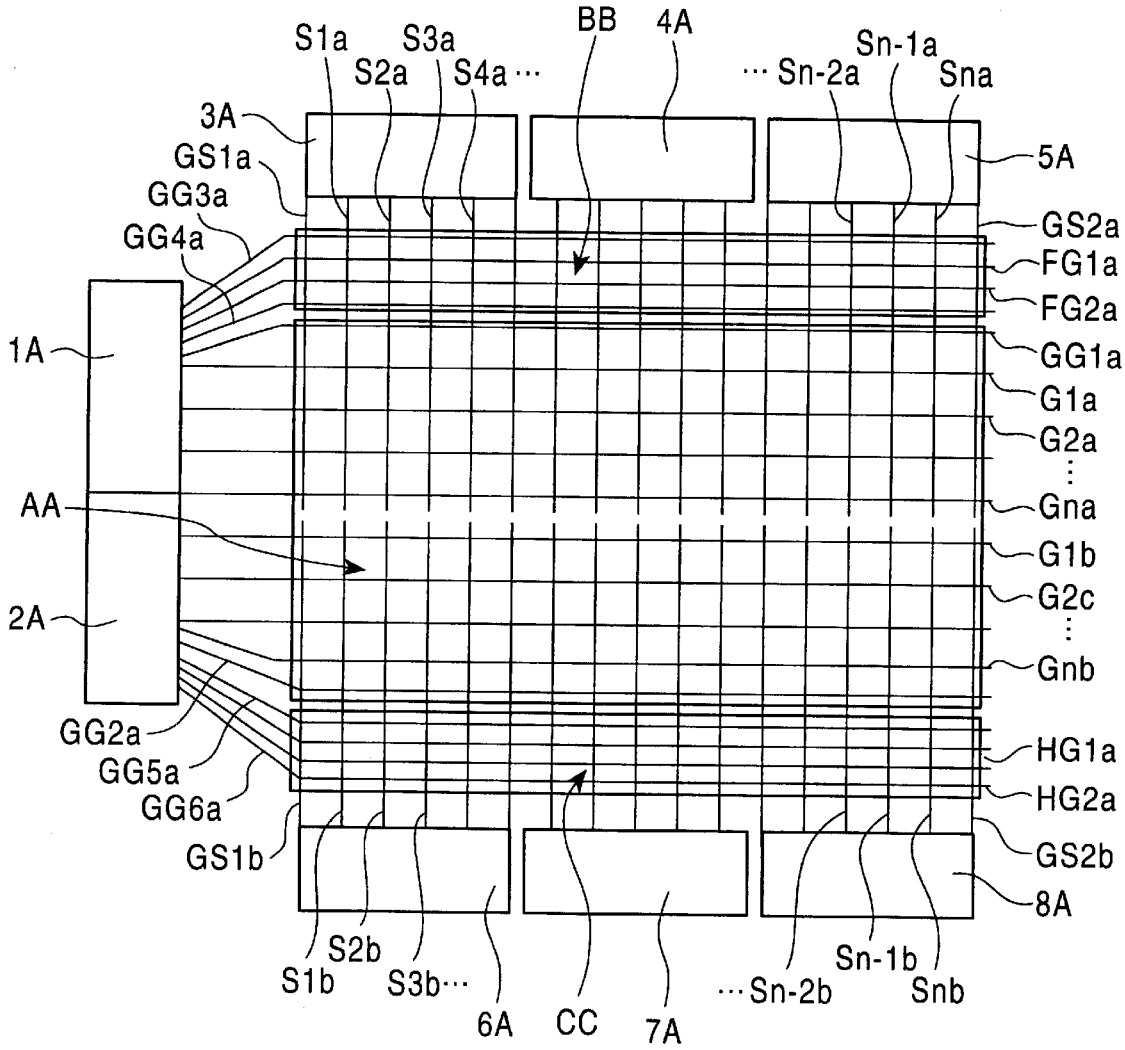
FIG. 4 is an outlined circuit diagram of a liquid-crystal display apparatus according to a second embodiment of the present invention.
Figure 5:
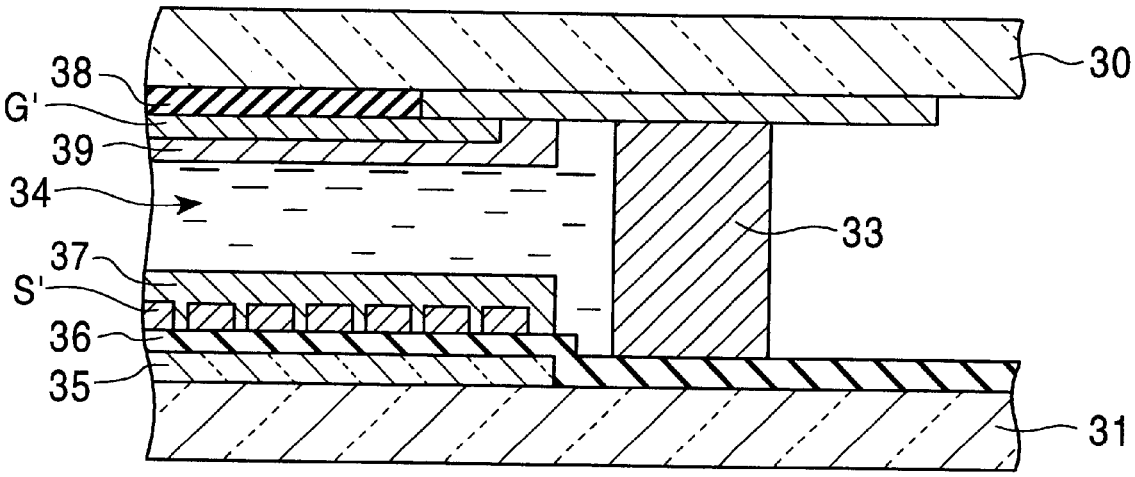
FIG. 5 is a cross-sectional view of a circuit shown in FIG. 4, formed on an actual liquid-crystal substrate.
Figure 6:
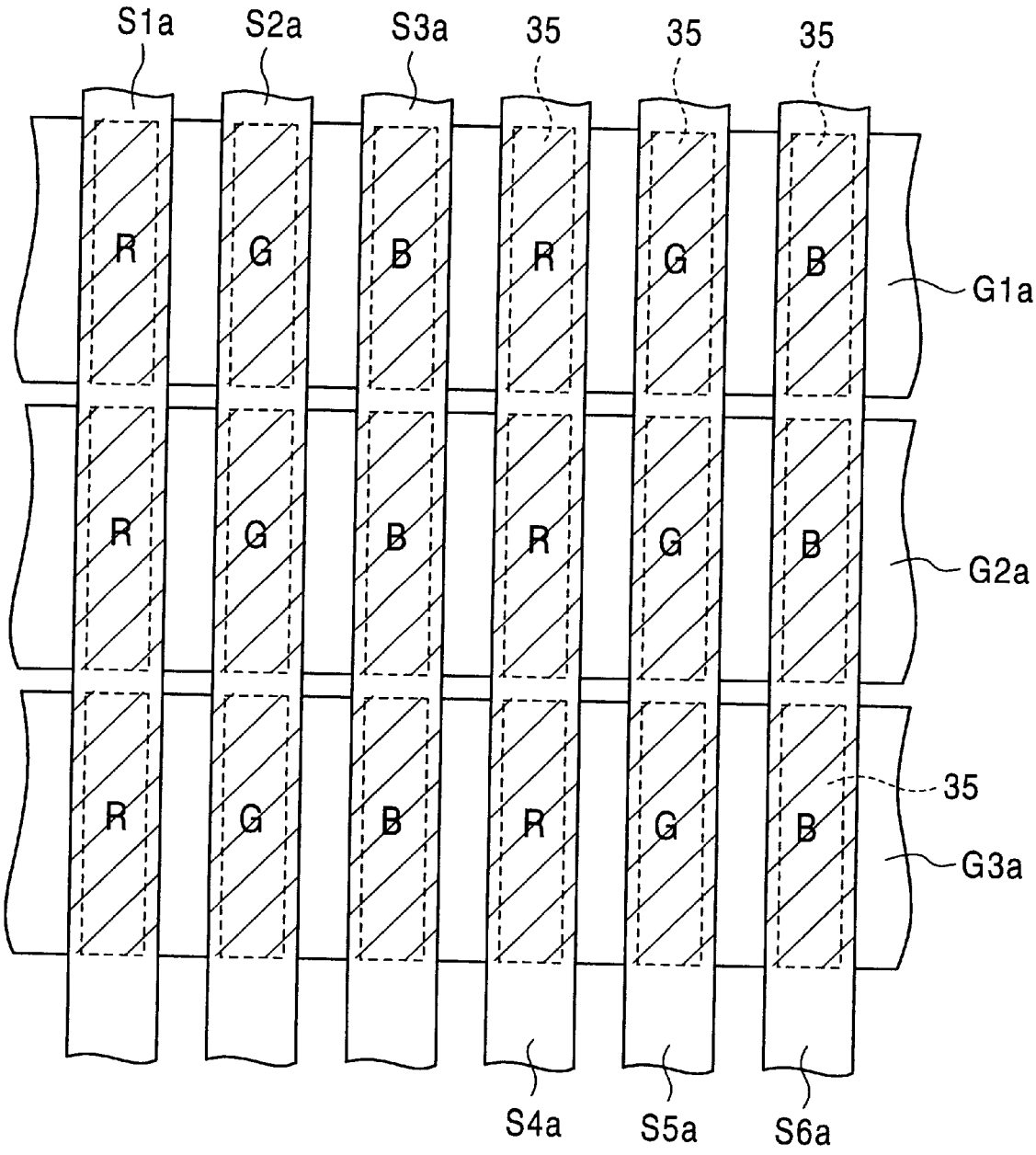
FIG. 6 is an outlined view showing circuit-line arrangement.

FIG. 4 to FIG. 6 show a passive-matrix liquid-crystal display apparatus according to an embodiment of the present invention. A line arrangement in the structure of the present embodiment is almost the same as that of the previous embodiment, but a main display area AA is divided into two sections vertically and driven.

In the previous embodiment, where thin-film transistors are used for driving, gate and source lines are disposed at regions which do not relate to display; a region corresponding to a pixel electrode 13 formed between lines shows a color indication; and three of such regions for the three primary colors collectively form one pixel 29. In the present embodiment, regions where lines arranged in a matrix manner intersect with each other relate to display.

Line electrodes are arranged in a matrix manner as shown in FIG. 4, and the main display area AA is divided into two sections vertically. In the upper section, common electrode lines G1a, G2a, G3a, . . . , and Gna and segment electrode lines S1a, S2a, S3a, . . . , and Sna are arranged; and in the lower section, common electrode lines G1b, G2b, G3b, . . . , and Gnb and segment electrode lines S1b, S2b, S3b, . . . , and Snb are arranged. The region where these lines are arranged is the main display area AA.

The common electrode lines G1a, G2a, . . . , and Gna are connected to a common driver (driving means) 1A in the same way as in the previous embodiment, where a part of the gate lines G1, G2, G3, . . . , and Gn is connected to the gate driver 1. The common electrode lines G1b, G2b, . . . , and Gnb are connected to a common driver (driving means) 2A in the same way as in the previous embodiment, where a part of the gate lines G1, G2, G3, . . . , and Gn is connected to the gate driver 2. The segment electrode lines S1a, S2a, . . . , and Sna are connected to segment drivers (driving means) 3A, 4A, and 5A, and the segment electrode lines S1b, S2b, . . . , and Snb are connected to segment drivers (driving means) 6A, 7A, and 8A.

Sub common electrode lines GG1a and GG2a are provided to determine the upper end and the lower end of the main display area AA. Sub common electrode lines FG1a, FG2a, and FGna (for simplicity, only FG1a and FG2a are shown in the figure) are formed in a first sub display area BB, and image-frame common electrode lines GG3a and GG4a are formed to determine the upper end and the lower end of the sub display area BB. Sub common electrode lines HG1a, HG2a, . . . , and HGna (for simplicity, only HG1a and HG2a are shown in the figure) are formed in a second sub display area CC, and image-frame common electrode lines GG5a and GG6a are formed to determine the upper end and the lower end of the sub display area CC. Sub segment electrode lines GS1a and GS2a are also formed to determine both right and left ends of the main display area AA and the sub display areas BB and CC.

In the liquid-crystal display apparatus having these line electrodes, liquid crystal 34 is sealed by a sealing material 33 between a pair of upper and lower transparent substrates 30 and 31 as shown in FIG. 5, and the horizontal lines are disposed at the lower-surface side of the upper substrate 30 and the vertical lines are disposed at the upper-surface side of the lower substrate 31.

More specifically, on the upper surface of the lower substrate 31, a color filter 35, an insulating film 36, vertical lines, and an alignment film 37 are laminated; and on the lower surface of the upper substrate 30, an insulating film 38, horizontal lines, and an alignment film 39 are laminated to form the liquid-crystal display apparatus.

Also in the structure of the second embodiment, a black matrix is disposed between the main display area AA and the sub display area BB to separate them, and a black matrix is disposed between the main display area AA and the sub display area CC to separate them, but the black matrixes are not shown in the figure. Specifically, in the cross-sectional structure shown in FIG. 5, the black matrixes may be formed at the upper substrate 30 or at the lower substrate 31.

In the present embodiment, since portions where lines intersect with each other when viewed from the top serve as display regions, red (R), green (G), and blue (B) color filters are sequentially disposed in that order at the portions where the common electrode lines G1a, G2a, G3a, . . . , and Gna and the segment electrode lines S1a, S2a, S3a, . . . , and Sna intersect, as shown in FIG. 6. The regions where these color filters are disposed serve as display regions.

In the liquid-crystal display apparatus having the structure shown in FIG. 4 to FIG. 6, a usual TV image can be displayed on the main display area AA. The horizontal lines and the vertical lines disposed in the sub display areas BB and CC can be used to display desired information on the sub display areas BB and CC. In this case, when the sub display areas BB and CC are used as a substitute for a tally lamp, if display is performed corresponding to a red color filter so as to display a red sign, a red horizontal bar is displayed at the sub display areas BB and CC, which are above and below the main display area AA. This red bar serves as a tally lamp. Since any color display can be used in the sub display areas BB and CC, a desired color indication is possible, in addition to a red indication. Therefore, the sub display areas BB and CC can be used for various color indications as well as for the function of a tally lamp.

Since common lines and segment lines are provided at the outer periphery of the main display area AA for the image frame and the image frame can be displayed in color, the image frame of the main display area AA can be indicated in a desired color. In the same way, since common lines and segment lines are provided at the outer peripheries of the sub display areas BB and CC for the image frames, the image frames of the sub display areas BB and CC can be displayed in a desired color.

In the liquid-crystal display apparatus of the present embodiment, an indication serving as a substitute for a tally lamp can be shown in the sub display areas BB and CC. Since the sub display areas BB and CC are integrated into the liquid-crystal display apparatus with a part of horizontal lines and vertical lines being also used therefor and it is not necessary to separately provide an LED for the liquid-crystal display apparatus, the display apparatus is made thinner by the amount of the LED. If a tally lamp formed of an LED is used, colors to be used are limited to red and green. When a liquid-crystal display apparatus having a color filter is used, however, a desired color can be selected. Therefore, a user's favorite color can be used. Although a tally lamp formed of an LED cannot display characters or images, a liquid-crystal display apparatus according to the present invention allows images and characters to be displayed in the sub display areas BB and CC separately from image information displayed on the main display area AA.

Figure 7:
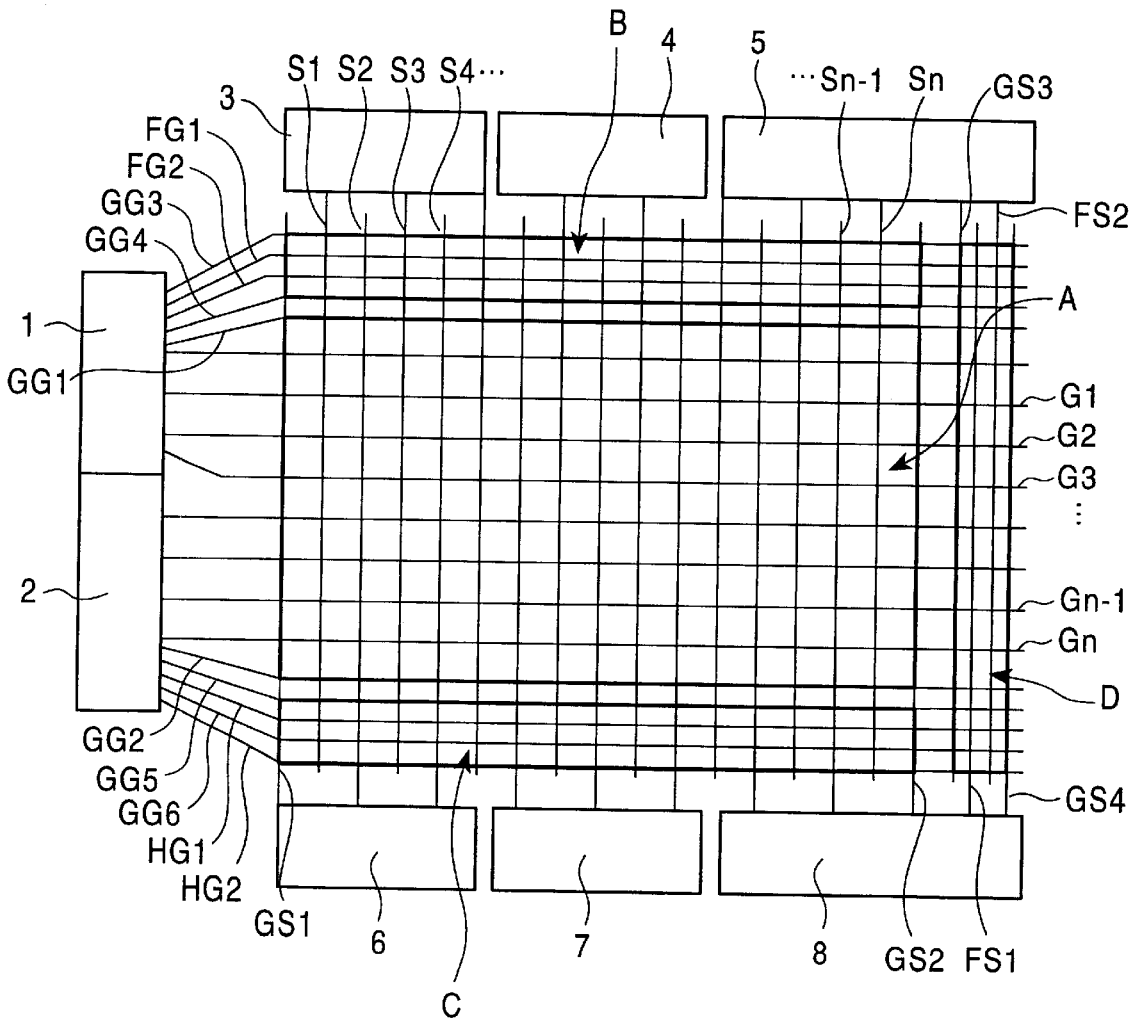
FIG. 7 is an outlined circuit diagram of a liquid-crystal display apparatus according to a third embodiment of the present invention.

FIG. 7 shows a liquid-crystal display apparatus according to a third embodiment of the present invention. In this embodiment, the same symbols as those used in the first embodiment are assigned to the same portions as those in the first embodiment, and descriptions thereof will be omitted.

This embodiment features in that a sub display area D is provided at the right side of the main display area A, in addition to the sub display areas B and C provided at the upper side and the lower side of the main display area A.

In the sub display area D, the horizontal lines used in the second embodiment are extended and used, and source lines are additionally provided at the right side of the main display area A. Sub vertical lines GS3 and GS4 are provided for the right and left ends of an image frame for the sub display area D, and the required number of sub vertical lines FS1, FS2, . . . , and FSn (for simplicity, only two lines are shown in FIG. 7) are provided therebetween. With the horizontal lines GG3, FG1, FG2, . . . , FGn, GG4, GG1, G1, G2, . . . , Gn, GG2, GG5, HG1, HG2, . . . , HGn, and GG6 and the sub vertical lines FS1, FS2, . . . , and FSn, a tally lamp indication or a desired indication, such as character indication and image indication, can be performed in the sub display area D.

As described above, one or more sub display areas may be formed around the main display area A. If necessary, four sub display areas can be provided.

In these embodiments, the numbers of horizontal lines and vertical lines can be set according to the resolution of a TV image. The aspect ratio of a screen is 16:9 in high-definition television (HDTV) and the aspect ratio of a screen is 4:3 in the NTSC system. To handle these two television systems, a liquid-crystal display apparatus is formed such that the numbers of horizontal lines and vertical lines match the number of pixels for HDTV; a screen having an aspect ratio of 4:3 is formed inside the screen having an aspect ratio of 16:9; and the remaining portions of the screen is displayed in black.

Figure 8:
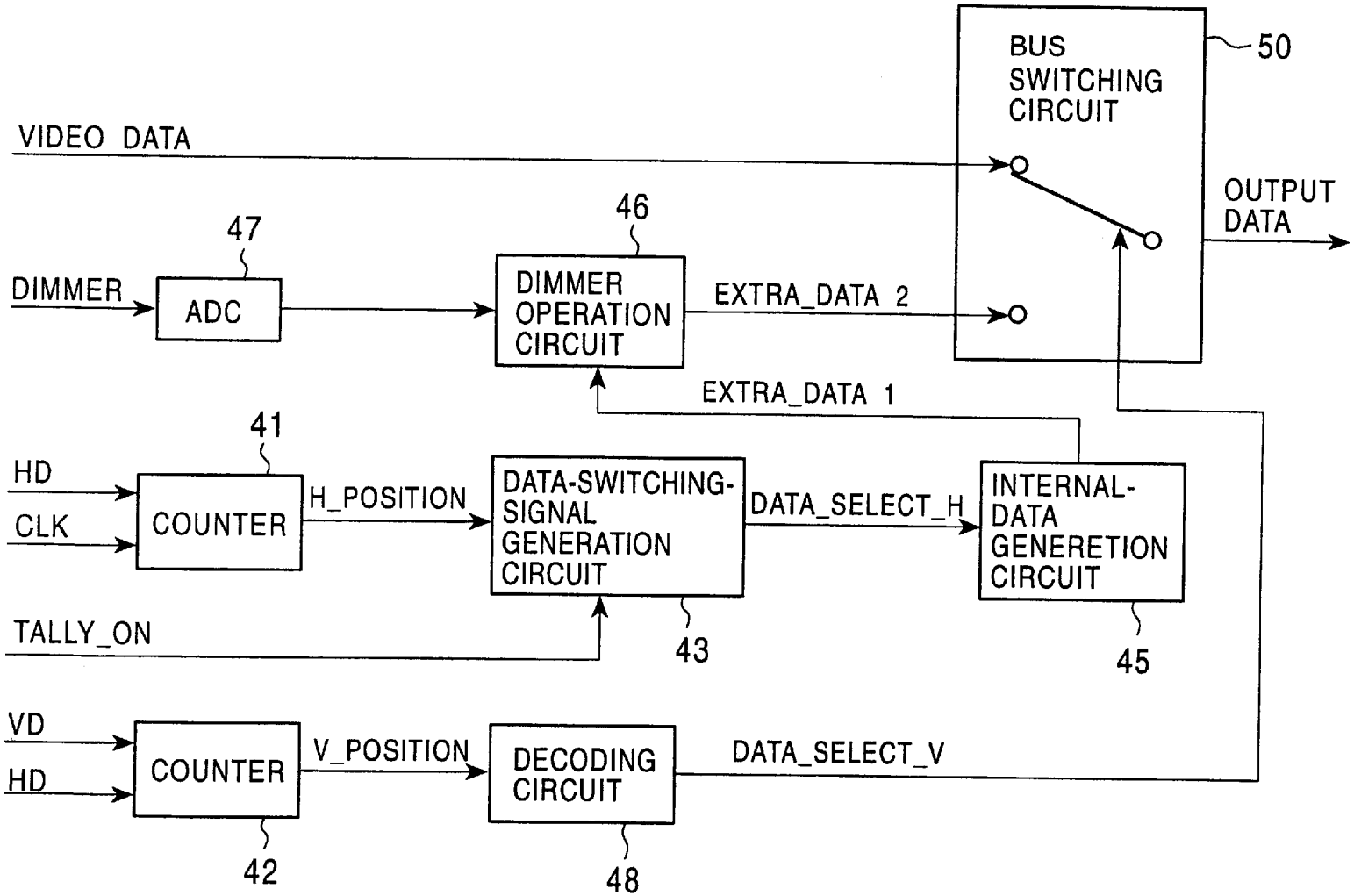
FIG. 8 is an outlined block diagram of a dimmer control section for a sub display area.

FIG. 8 shows an outlined structure of a dimmer control (luminance control) section for a sub display area.

A counter 41 counts clocks CLK with a horizontal synchronous signal HD being used as a trigger to generate horizontal display data H_POSITION. A data-switching-signal generation circuit 43 generates a data switching signal DATA_SELECT_H from the horizontal display data H_POSITION and a tally-on signal TALLY_ON. When a sub display area is divided horizontally, one or more tally-on signals may be used. An internal-data generation circuit 45 switches information data to be displayed on the sub display area and generates display data EXTRA_DATA1 according to the data switching signal. The information data refers to tally-lamp color information. It may be character information or image information. These pieces of information are specified in advance in the internal-data generation circuit. It may be configured that these pieces of information can be externally modified.

A dimmer operation circuit applies an operation to the display data EXTRA_DATA1 and a digital dimmer control signal converted by an A/D converter (ADC) 47 to generate display data EXTRA_DATA2 in which the luminance of the signal to be displayed on the sub display area is controlled.

On the other hand, a counter 42 counts the number of the horizontal synchronous signals HD with a vertical synchronous signal VD being used as a trigger to generate a vertical display position data V_POSITION. A decoding circuit 48 generates a switching signal DATA_SELECT_V for switching the sub display area and the main display area according to the vertical display position data V_POSITION.

A bus switching circuit 50 switches video data for the main display area and the display data EXTRA_DATA2 for the sub display area according to the switching signal and sends output data to a source driver.

As described above, the transmittance of the liquid crystal in the sub display area can be made variable separately from that of the main display area with the use of the dimmer control signal.

What is claimed is:

1. An image display apparatus used for a viewfinder of a TV camera comprising:

a main display area having a plurality of pixels arranged horizontally and vertically in an array condition;

at least one sub display area formed on a same plane as the main display area, wherein the at least one sub display area is disposed separately from said main display area and having a plurality of pixels arranged horizontally and vertically in an array condition, wherein the at least one sub display area comprises a color filter and at least one tally lamp, wherein the at least one tally lamp includes an indication of a plurality of colors;

a plurality of lines arranged horizontally and vertically in a matrix manner against said main display area and said sub display area for driving the plurality of pixels;

a driving circuit for applying a driving signal to said plurality of lines disposed in the matrix manner;

a luminance-signal control circuit for controlling the luminance of said sub display area; and wherein the luminance control circuit comprises:

a dimmer operation circuit configured to receive a digital dimmer control signal and a display data EXTRA_DATA 1, wherein the dimmer operation circuit converts the received digital dimmer control signal and the display data EXTRA_DATA 1 into display data EXTRA_DATA 2 in response to receiving the converted digital dimmer control signal and the display data EXTRA_DATA 1; and a bus switching circuit configured to connect with the EXTRA_DATA 2 to output data to control luminance of a signal display on the at least one sub display area.

2. An image display apparatus according to claim 1, wherein the at least one sub display area is disposed above the main display area, wherein the driving circuit is at least one gate line, at least one source line, at least one gate driver and at least one source driver.

3. An image display apparatus according to claim 1, wherein the main display area is comprised of two divided vertical sections, wherein the at least one sub display area being disposed at one of at least two outside portions of the divided vertical two sections of the main display area.

4. An image display apparatus according to claim 3, wherein the driving circuit is comprised of at least one gate line, at least one source line, at least one gate driver and at least one source driver.

5. An image apparatus according to claim 1, wherein the sub display area is disposed on at least one of three different places, wherein the first place is at an upper side portion of the main display area, wherein the second place is at a lower side portion of the main display area, and wherein the third place is at a side portion of the main display area opposite a side where at least one gate driver is disposed.

6. An image apparatus according to claim 1, wherein the luminance control circuit further comprises:

a counter configured to receive a horizontal synchronous signal HD, the counter is also configured to receive and count a clock, wherein the counter generates a horizontal display data position H_POSITION as a response to receiving the horizontal synchronous signal HD and the counted clock;

a data-switching signal generation circuit configured to received the horizontal display data position H_POSITION and a TALLY_ON signal, wherein the data-switching signal generation circuit generates a data switching signal DATA_SELECT_H in response to receiving the horizontal display data position H_POSITION and a TALLY_ON signal;

an internal data generation circuit configured to receive the data switching signal DATA_SELECT_H, wherein the internal data generation circuit generates display data EXTRA_DATA 1 in response to receiving the data switching signal DATA_SELECT_H; and an analog digital converter configured to receive the digital dimmer control signal, wherein the analog digital converter converts the received digital dimmer control signal in response to receiving the digital dimmer control signal.

7. An image display apparatus according to claim 1, wherein the plurality of pixels in the main display area are of a size different from a size of the plurality of pixels in the at least one sub display area.

* * * * *

UNITED STATES PATENT AND TRADEMARK OFFICE

CERTIFICATE OF CORRECTION

PATENT NO. : 6,515,643 B1
DATED : February 4, 2003
INVENTOR(S) : Mitsuo Kamiko et al.

It is certified that error appears in the above-identified patent and that said Letters Patent is hereby corrected as shown below:

Column 12,
Line 46, delete "received" and substitute -- receive -- in its place.

Signed and Sealed this

Eighth Day of April, 2003

JAMES E. ROGAN
*Director of the United States Patent and Trademark Office*